United States Patent [19]

Cowatch et al.

[11] Patent Number: 4,767,512

[45] Date of Patent: Aug. 30, 1988

[54] PROCESS AND APPARATUS FOR PREVENTING OXIDATION OF METAL BY CAPACITIVE COUPLING

[76] Inventors: George Cowatch; George Cowatch, Sr., both of Colerain St., Sligo, Pa. 16255

[21] Appl. No.: 937,218

[22] Filed: Dec. 3, 1986

[51] Int. Cl.[4] ..... C23F 13/00

[52] U.S. Cl. ..... 204/147; 204/196; 307/95

[58] Field of Search ..... 204/147, 148, 196, 197; 307/95

[56] References Cited

U.S. PATENT DOCUMENTS

| | | | |
|---|---|---|---|
| 3,242,064 | 3/1966 | Byrne | 204/196 |
| 3,560,359 | 2/1971 | Hood | 204/196 |
| 3,657,084 | 4/1972 | Beer | 204/147 |
| 3,692,650 | 9/1972 | Kipps | 204/147 |
| 3,868,313 | 2/1975 | Gay | 204/196 |
| 4,226,694 | 10/1980 | Baboian | 204/196 |
| 4,255,242 | 3/1981 | Freeman | 204/147 |
| 4,437,957 | 3/1984 | Freeman | 204/147 |
| 4,487,672 | 12/1984 | Vrable | 204/148 |
| 4,528,460 | 7/1985 | Staerzl | 307/95 |
| 4,647,353 | 3/1987 | McCready | 204/147 |

*Primary Examiner*—T. Tung

*Attorney, Agent, or Firm*—Bacon & Thomas

[57] ABSTRACT

An effective process of preventing the oxidation of metal objects by capacitive coupling is disclosed. An electric current is impressed into the metal object by treating the metal object as the negative plate of a capacitor. This is achieved by a capacitive coupling between the metal object, a dielectric material and a positive plate. Pulses of direct current are provided to the positive plate. The metal object has a common ground with the means for providing the pulses.

20 Claims, 2 Drawing Sheets

PROCESS AND APPARATUS FOR PREVENTING OXIDATION OF METAL BY CAPACTIVE COUPLING

The inventors are George Cowatch (U.S. citizen), residing in Altoona, Pa., and George Cowatch, Sr. (U.S. citizen), residing in Sligo, Pa.

FIELD OF THE INVENTION

The present invention relates to processes of preventing the oxidation of metal objects in an oxidizing environment, and apparatus therefor. An oxidizing environment normally contains at least one chemical which, in that environment, has a sufficient reduction potential to be reduced by acquiring at least one electron from the metal.

In general, a chemical is reduced when it acquires at least one electron in an electrochemical reaction. Conversely, a chemical is oxidized when it loses at least one electron in an electrochemical reaction.

The present invention also relates to processes of preventing rust in structures made of iron and steel that are exposed to oxidizing environments.

BACKGROUND OF THE INVENTION

The prior art has long sought an effective method of preventing the oxidation of metal objects which are exposed to an oxidizing environment. However, the methods and apparatus of the prior art have proven to be relatively ineffective.

Generally stated, the problem addressed by the present invention arises because objects made of metal are frequently exposed to oxidizing environments. These oxidizing environments contain one or more chemical substances which, under the relevant conditions, tend to be reduced.

In an oxidizing environment, metal objects tend to give up electrons, thereby reducing the substances in the surrounding environment, and oxidizing the surface of the metal object. As the oxidation progresses, the metal object eventually becomes degraded to the point that it is unsuitable for its intended purpose.

Examples of the problem include the metal fenders of land vehicles, and the metal girders of vehicular bridges, which are exposed to salt that is spread on the roads to prevent the formation of ice in cold climates. The salt melts the snow or ice and produces an aqueous salt solution. A number of the substances in the solution have a sufficient reduction potential so as to extract electrons from the surfaces of the metal fenders and girders, thereby oxidizing the metal. If the fenders or girders are made of iron or steel, then the oxidation may first produce the undesirable appearance of rust on the exterior surface. If the oxidation of the fender is allowed to continue, then the fender will rust through at various locations, and then disintegrate. Similarly, if the girder of a vehicular bridge is allowed to oxidize for a sufficiently long period of time, it becomes unable to carry the necessary load and collapses.

Sea water also presents an oxidizing environment for the hulls of ships and boats which are made of metal, as well as offshore oil wells and the like. Once again, if the oxidation is allowed to continue, the structure eventually collapses or disintegrates.

In response to this problem, numerous methods have been devised to reduce the rate of oxidation of metal objects. The most common method is to apply a protective coating to the surface of the metal before it is placed into operation. However, the coating eventually degrades and exposes the metal to the oxidizing environment. The results in the necessity of repeating the coating operation, or replacing the metal object (both of which can be impractical and relatively expensive).

The prior art also includes numerous cathodic protection systems. Generally speaking, these systems treat the metal object to be protected from oxidation as the cathode of an electrolysis circuit. These methods normally require an anode, a source of electric energy, and an aqueous solution. The anode and cathode must be in contact with the aqueous solution. The source of electric energy is then used to create a current between the anode and the cathode. As the source of electric energy provides electrons to the cathode (which is the metal object being protected from oxidation), the substances in the aqueous solution that have sufficient reduction potential to be reduced acquire the electrons provided by the electric current, rather than electrons from the metal, and are reduced. The rate of oxidation of the cathode (the metal object being protected from oxidation) is significantly reduced because the majority of the electrons needed for reduction of the chemical substances in the aqueous solution (the environment surrounding the metal object being protected) are provided by the electric current, rather than the metal in the cathode.

U.S. Pat. No. 3,242,064 discloses a cathodic protection system. It provides a corrosion reduction system in which pulses of direct current (DC) are supplied to the metal surface to be protected, such as the hull of a ship. The environment surrounding the hull varies, thereby varying the amount of current necessary to prevent oxidation of the metal hull. A signal from a sensing half-cell is used to automatically control the ratio of the pulse duration to the time between the pulses, depending on the conditions.

U.S. Pat. No. 3,692,650 also discloses a cathodic protection system. It is applicable to well casings and pipelines that are buried in conductive soils, the inner surfaces of tanks which contain corrosive solutions, and the submerged portions of ship hulls, pier structures and other offshore metal structures. This system uses a short pulsed DC voltage, and a continuous direct current. The width of the voltage pulses is sufficient to permit acid ion conversion, but not wide enough to permit undesirable chemical reactions. The pulse repetition frequency is made equal to the resonant frequency of the series circuit of the capacitance of the taffel double layer (a layer of charge that is allegedly formed at approximately 100 Angstroms from the surface of the structure) and the inductance between the anode and the cathode structure. The voltage amplitude is selected to give a maximum throw down the structure in order to effect polarization as quickly as possible. Throw is defined as the distance from the point at which current is supplied to the structure, to the point at which the current shorts back to the anode.

The cathodic protection systems of the prior art have failed to achieve an effective process of preventing the oxidation of metal objects. Moreover, they are of very limited utility with respect to metal objects that are not at least partially immerged in an electrically conductive medium, such as sea water or a conductive soil. Accordingly, above ground metal objects (such the as metal fenders of land vehicles, and the metal girders of vehicular bridges) are not effectively protected by these systems, because they are not regularly immerged in the electrolyte solution which is required to complete the series circuit between the anode and the cathode.

SUMMARY OF THE INVENTION

The present invention overcomes the problems of the prior art and provides an effective process of preventing the oxidation of metal objects by capacitive coupling and impressed current. An electric current is impressed into the metal object to be protected from oxidation, by treating the metal object as the negative plate of a capacitor. This is achieved by a capacitive coupling between the metal object to be protected, and a means for providing pulses of direct current. The metal object to be protected, and the means for providing pulses of direct current have a common ground. The capacitive coupling involves a positive plate which is adjacent to a dielectric material, which is adjacent to the metal object to be protected. The amount of voltage and current, the frequency and width of the pulses, the nature of the dielectric material, the puncture voltage of the dielectric material, the size and shape of the dielectric material, the nature of the positive plate, the size and shape of the positive plate, and the means used to provide the pulses of direct current, can all be varied within operational limits, depending upon not only the nature and environment of the metal object to be protected, but a variety of other factors, as more fully discussed below.

One of the advantages of the present invention is its potential to be self-regulating. In a preferred embodiment of the present invention, the exposed surfaces of the metal object to be protected from oxidation are coated with a relatively dielectric coating, thereby forming a potentially capacitive surface. When an aqueous solution (that contains at least one chemical which, in that environment, has a sufficient reduction potential to be reduced by acquiring electrons from the metal) contacts this surface, a capacitive surface is created. The metal object functions as the negative plate, the coating functions as the dielectric material, and the aqueous solution functions as the positive plate. The amount of impressed current in the vicinity of the capacitive surface is proportional to the amount of surface area at the interface of the aqueous solution and the coating. Accordingly, as the area of the metal object which is exposed to the oxidizing environment increases, so does the impressed current. Thus, the greater the need for protection against oxidation, the greater the amount of impressed current which protects against oxidation.

DETAILED DESCRIPTION OF THE INVENTION

Figure 1:
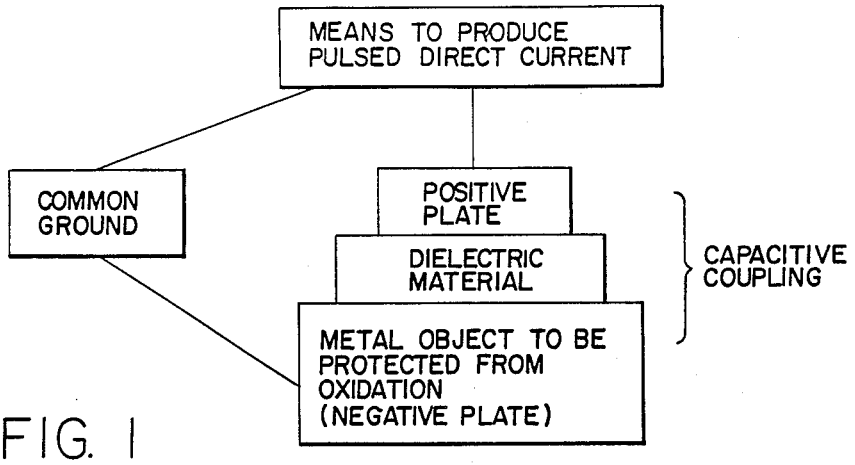
FIG. 1 is a schematic diagram of a process and apparatus of the present invention.

FIG. 1 provides a schematic diagram of a process and apparatus of the present invention. A means to produce pulsed direct current is connected to the positive plate of the capacitive coupling. The positive plate is adjacent to a dielectric material, which is adjacent to the metal object to be protected from oxidation (in the following, the term "metal object" means the "metal object to be protected from oxidation", unless the context indicates otherwise). The metal object functions as the negative plate in the capacitive coupling. The means to produce pulsed direct current then provides pulses of direct current to the positive plate. During each cycle of the capacitive coupling, a positive charge is created on the positive plate. This causes a negative charge to develop in that portion of the metal object, which is immediately adjacent to the dielectric material. As the cycle of the capacitive coupling is completed, the positive charge on the positive plate decreases. This causes a decrease in the negative charge on the portion of the metal object, which is adjacent to the dielectric material. Accordingly, as the capacitive coupling goes through repetitive cycles, the electrons in the metal object to be protected are initially drawn toward the capacitive coupling and then repelled away from the capacitive coupling, which creates an impressed current in the metal object. This pumping of electrons (caused by the cycling of the capacitive coupling) increases the tendency of surplus electrons from the impressed current to bleed off from the metal object. These surplus electrons are available to reduce any chemicals in the environment surrounding the surfaces of the metal object.

Accordingly, when the metal object is in an oxidizing environment, the surplus, pumped electrons are more likely to provide the electrons necessary to reduce the chemicals in the oxidizing environment. This reduces the rate of oxidation of the metal object, because the metal itself does not give up electrons.

FIG. 1 does not illustrate any insulation around the capacitive coupling. Obviously, it is preferred to have sufficient electrical insulation around the positive plate so as to prevent arcing from the positive plate to the metal object, and to prevent the unintended discharge of the positive plate to someone or something which comes into contact with the positive plate.

The dielectric material of the capacitive coupling must have a sufficiently high puncture voltage so as to allow the DC pulses to impress a current that is sufficient to prevent oxidation of the metal object.

Obviously, FIG. 1 is not drawn to scale, as the size of the metal object will in most cases be much much larger than the area of the capacitive coupling with the dielectric material and the positive plate. For example, in a typical land vehicle, the surface area common to both the dielectric material and the metal object, will be about 25 square centimeters in most cases. This will be sufficient to protect the metal structure of the land vehicle from oxidation, despite the fact that the land vehicle will in most cases be more than one meter in height, more than three meters in length, and more than two meters in width.

Multiple capacitive couplings may be necessary for metal objects of larger size. For example, a vehicular bridge that is more than one hundred meters in length will probably require multiple capacitive couplings.

These capacitive couplings may be placed in a linear manner along the length of the vehicular bridge.

When multiple capacitive couplings are attached to a single metal object, it will be possible to use either a single means to produce pulsed direct current, or multiple means to produce pulsed direct current, in most cases. In some circumstances, it may be advantageous to synchronize the pulses of direct current to the positive plate of each capacitive coupling. In other circumstances, it may be preferable to arrange the capacitive couplings in a linear manner, and control the single means, or the multiple means for producing pulsed direct current so that the capacitive couplings are alternatively 180 degrees out of phase (for example, with six capacitive couplings arranged in a linear manner along a metal object, the first, third and fifth capacitive couplings would receive a pulse of direct current 180 degrees after a pulse of direct current was provided to the second, fourth and sixth capacitive couplings).

The electric energy for the means to produce pulsed direct current can be provided in a number of ways, depending upon the environment of the metal object. For an automobile, the electrical system of the automobile (including the storage battery) can provide the necessary electric energy. For structures such as vehicular bridges which are adjacent to normal electric power lines, the electric power lines can be used to provide the electric energy. On the other hand, if the vehicular bridge is in a remote location, then a combination of solar cells and a storage battery may be used to provide the electric energy.

When a storage battery is used as the source of the electric energy, it is preferred than an automatic cutoff means for disconnecting the battery be provided so as to avoid completely draining the battery. For example, when the electrical system of a typical automobile is used as the source of electric energy for the pulsed direct current, then it is preferred that the battery be automatically disconnected at any time that the battery is drained to about 85 percent of its capacity, or less. If a typical automobile is driven on average approximately 15 miles in every period of 10 days, then it should be unnecessary for such automatic cutoff means to disconnect the battery.

Depending upon the environment of the metal object, it is possible to use pulses of direct current in a range from about $10^{-6}$ to about $10^{+6}$ volts, with a current in the microamp range. The cycling of each capacitive coupling may be in a range of from about 1 hertz to about $10^{+6}$ hertz.

When the present invention is used to protect the metal in an automobile from oxidation, a wide variety of parameters are possible. In one embodiment of the invention, each pulse of direct current will be about 5,000 to 6,000 volts, the current will be in the microamp range, and the frequency of the pulses will be in the one kilohertz range.

A frequency in the one kilohertz range is selected for a number of reasons, including the relatively low likelihood that electromagnetic radiation of this frequency will interfere with other electronic devices.

The puncture voltage of the dielectric material in such an automobile protection system will be about 10 kilovolts. This puncture voltage should be sufficient because the system will produce only about 5 to 6 kilovolts at the positive plate of the capacitive coupling.

When the present invention is used in a manner which exposes humans to possible contact with the metal object or any other part of the capacitive coupling, it is important that the means for producing pulsed direct current, and all other portions of such a system of preventing the oxidation of metal objects, not produce more than about 10 joules of energy, so as to avoid injury to humans in the event of a system malfunction. Even in the event of a malfunction of the embodiments of the invention specifically described in this document, and the almost complete charging of the capacitive coupling, the maximum output is only about 1.25 to 1.50 joules. In normal operation, the embodiments of the invention described in this document will not provide anywhere near this amount of energy because of the rapid cycling of the capacitive connection.

When the process of the present invention is used to protect the metal in a conventional automobile, truck or the like from oxidation, the dielectric material of the capacitive coupling is preferably attached to a metallic part of the body of the vehicle by using high dielectric strength (e.g., 10 kilovolt) silicone adhesive. The adhesive is preferably a fast curing one, which will cure sufficiently in about 15 minutes so as to secure the dielectric material to the metal object, and which will cure relatively completely within about 24 hours.

The means to produce pulsed direct current may comprise two stages:

- a first stage to provide outputs of a higher voltage of alternating current (AC), and a lower voltage of alternating current; and
- a second stage for rectifying (biasing) both the higher and lower AC voltages output by the first stage into DC, and pulsating the DC.

The first stage may comprise a multivibrator based inverter, a push/pull saturated core transformer or an equivalent device.

Whenever the present invention is used to prevent the oxidation of a metal object which serves as the ground in an electrical system, the lower of the two voltages output by the first stage should be equal to or greater than the voltage of the electrical system.

When the present invention is used to protect the metal in an automobile, truck or the like, from oxidation, the means to produce pulsed direct current may comprise two stages:

- a first stage to provide outputs of 400 volts of alternating current (AC), and 12 volts of alternating current; and
- a second stage for rectifying (biasing) the 400 volts AC and the 12 volts AC into DC, and pulsating the DC.

When the present invention is used to protect the metal in an automobile, truck or the like, from oxidation, the source of electric power for the first stage is preferably the 12 volt direct current electrical system of the vehicle. The first stage may alternatively comprise either a multivibrator based inverter, or a push/pull saturated core transformer.

Figure 2:
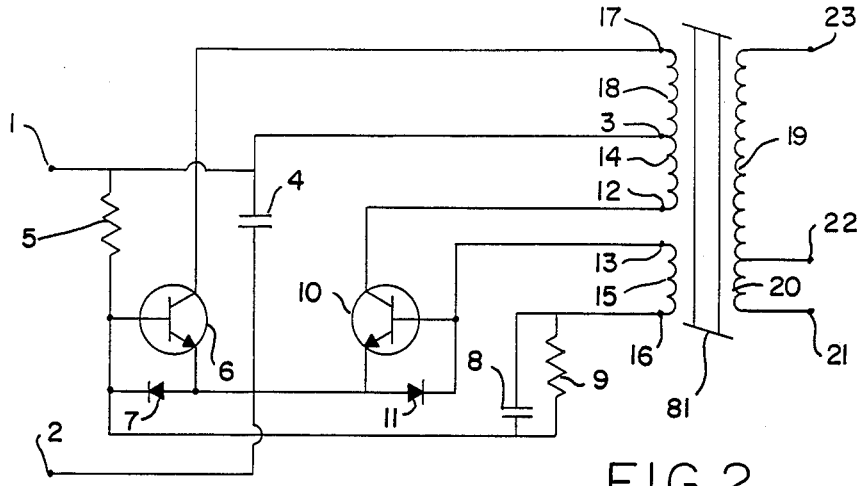
FIG. 2 is a circuit diagram of a push/pull saturated core transformer, which may be used to practice the present invention.

FIG. 2 is a circuit diagram of a push/pull saturated core transformer, which can also be described as a saturable core DC inverter, and may be used to practice the present invention. Terminal 1 is connected to the positive side of the electrical system of the vehicle, and terminal 2 is connected to the negative side of the electrical system of the vehicle. The vehicle's electrical system is a 12 volt negative ground system. Accordingly, the lower voltage output by the first stage of the means for producing pulsed DC, must be 12 volts or more.

Terminal 1 is connected in parallel to core 81 at connection 3, capacitor 4, and resistor 5. Capacitor 4 is rated at 100 microfarads and 50 volts. Resistor 5 is rated at 4.7 kilohms and 0.5 watt. Resistor 5 is also connected in parallel to transistor 6, diode 7, capacitor 8, and resistor 9. Resistor 5 creates an imbalance in the system, and initiates the first cycle of transistor 6, after electrical power is initially supplied to the system by connections 1 and 2 to the electrical system of the vehicle. Transistor 6 is a Phillips part no. ECG 152 NPN, or the equivalent. Silicon diode 7 is rated at 50 volts and 1.0 amp, Motorola part no. IN4001. Capacitor 8 is rated at 0.007 microfarad and 100 volts. Resistor 9 is rated at 82 ohms and 10 watts. Connection 2 to the negative side of the electrical system of the vehicle, is connected in parallel to capacitor 4, transistor 6, diode 7, transistor 10, and diode 11. Silicon diode 11 is rated 50 volts and 1.0 amp, Motorola part no. IN4001. Transistor 10 is a Motorola part no. ECG 152 NPN, or the equivalent. Transistor 10 is connected at point 12 (input to the primary winding) to second winding 14 around saturable ferrite core transformer 81. Transistor 10 is also connected at point 13 (the output feedback) to third winding 15 around transformer 81. Capacitor 8 and resistor 9 are connected at point 16 (output from feedback) to third winding 15 around transformer 81. Transistor 6 is connected at point 17 (input to primary) to first winding 18 around transformer 81. Transformer 81 is preferably a ferroxcube pot core number 2316 PA 2503 BZ, or the equivalent. First winding 18 and second winding 14 are each 7 turns of number 20 wire. Third winding 15 is 9 turns of number 20 wire. Fourth winding 19 is 225 turns of number 30 wire, and fifth winding 20 is 10 turns of number 30 wire.

The output is as follows: connection 21 from fifth winding 20 provides the system ground for the means for producing pulsed DC; connection 22 from fourth winding 19 and fifth winding 20 provides 12 volts AC; and connection 23 from fourth winding 19 provides 400 volts AC. This output is provided to the second stage, which is more fully discussed below with respect to FIG. 4.

Figure 3:
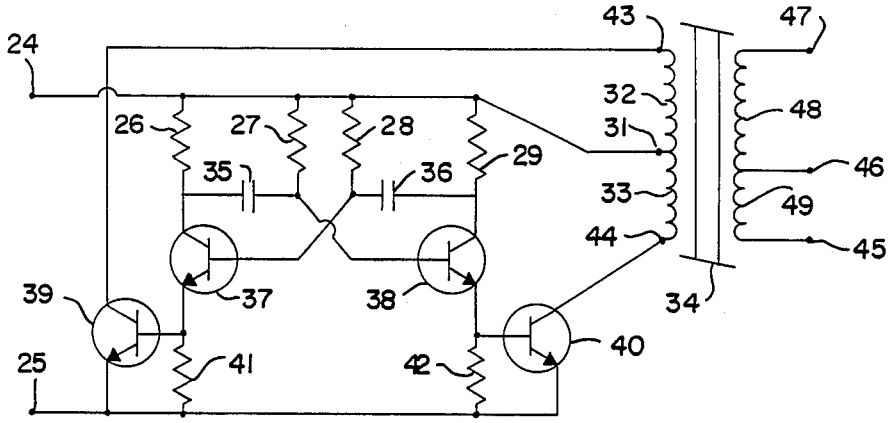
FIG. 3 is a circuit diagram of a multivibrator based inverter, which may be used to practice the present invention.

FIG. 3 is a circuit diagram of a multivibrator based inverter, which may be used to practice the present invention. As discussed above, it is an alternative to the saturable core DC inverter discussed above with respect to FIG. 2, as the first stage of the means for producing pulsed direct current. With reference to FIG. 3, the multivibrator based inverter is connected at point 24 to the positive side of the 12 volt direct current electrical system of the vehicle, and at point 25 to the negative side of that system. The positive side of the vehicle electrical system is connected in parallel through point 24 to resistors 26, 27, 28 and 29, as well as at point 31 to first winding 32, and second winding 33 about linear output core transformer 34. Resistors 26 and 29 are each rated at 2.2 kilohms and 0.5 watt. Resistors 27 and 28 are each rated at 220 kilohms and 0.5 watt. Resistor 26 is connected in parallel to capacitor 35 and transistor 37. Resistor 27 is connected in parallel to capacitor 35 and transistor 38. Resistor 28 is connected in parallel to transistor 37 and capacitor 36. Resistor 29 is connected in parallel to capacitor 36 and transistor 38. Capacitors 35 and 36 are each rated at 0.0007 microfarad and 25 volts polarized.

Transistor 37 is connected in parallel to transistor 39 and resistor 41. Transistor 38 is connected in parallel to resistor 42 and transistor 40. Transistors 37, 38, 39 and 40 are each Phillips part no. ECG 152 NPN, or the equivalent. Resistors 41 and 42 are each rated at 8.0 kilohms and 0.5 watt. The negative side of the 12 volt electrical system of the vehicle is connected in parallel through connection 25 to transistors 39 and 40, and resistors 41 and 42. Transistor 39 is connected to first winding 32 at point 43. Transistor 40 is connected to second winding 33 at point 44. First winding 32 and second winding 33 are each 10 turns of number 20 wire around linear output core transformer 34. The third winding 48 is 460 turns of number 30 wire around linear output core transformer 34. Fourth winding 49 is 20 turns of number 20 wire around linear output core transformer 34.

The output of the multivibrator based inverter is as follows: connection 45 from fourth winding 49 provides the system ground for the means for producing pulsed DC; connection 46 to the third and fourth windings 48 and 49, respectively, provides 12 volts AC; and connection 47 to the third winding 48 provides 400 volts AC.

Figure 4:
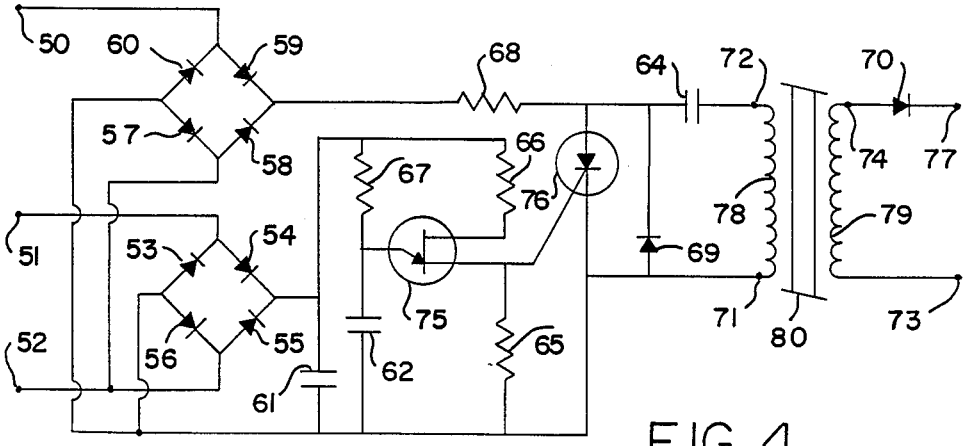
FIG. 4 is a circuit diagram of a rectifier pulsator, which may be used to practice the present invention.

FIG. 4 is a circuit diagram of a rectifier pulsator, which may be used to practice the present invention. It is the second stage of the means for producing pulsed direct current. The second stage rectifies (biases) the alternating current provided by the first stage into direct current, and pulsates the direct current. The output from the first stage is input to the second stage as follows: with reference to the saturable core DC inverter shown in FIG. 2, 400 volts AC is output at point 23, which is connected to point 50, 12 volts AC is output at point 22 and connected to point 51, and the system ground is output at point 21 and connected to point 52; and with respect to the multivibrator based inverter shown in FIG. 3, 400 volts AC is output at point 47 and input at point 50; 12 volts AC is output at point 46 and input at point 51, and the system ground is output at point 45 and input at point 52.

In the second stage, the 400 volts AC input at point 50 is connected in parallel to diodes 59 and 60. The 12 volts AC input at point 51 is connected in parallel to diodes 53 and 54. The system ground input at point 52 is connected in parallel to diodes 55, 56, 57 and 58. Each of silicon diodes 53, 54, 55 and 56 are rated at 50 volts and 1.0 amp, Motorola part no. IN4001. Each of silicon diodes 57, 58, 59 and 60 are rated at 1,000 volts and 2.5 amps, Motorola part no. IN4007. Diodes 53, 56, 57 and 60 are connected in parallel to capacitors 61 and 62, resistor 65, SCR 76, diode 69 and at point 71 to first winding 78 around pulse transformer core 80.

Electrolytic capacitor 61 is rated at 1,000 microfarads and 25 volts. Ceramic capacitor 62 is rated at 0.022 microfarad and 25 volts. Resistor 65 is rated at 39 ohms and 0.25 watt. Diode 69 is rated at 1,000 volts and 2.5 amps, Motorola part no. IN4007. SCR (Silicon Controlled Rectifier) 76 Phillips part no. ECG 5448, or the equivalent. Diodes 54 and 55 are connected in parallel to capacitor 61, resistor 67 and resistor 66. Resistor 66 is rated at 100 ohms and 0.25 watt. Resistor 67 is rated at 68 kilohms and 0.25 watt. Resistor 67 is connected in parallel to capacitor 62 and transistor 75. Transistor 75 is a 2N2646 unijunction. Resistor 66 is connected to transistor 75. Transistor 75 is connected in parallel to resistor 65 and SCR 76. Diodes 58 and 59 are connected in parallel to resistor 68. Resistor 68 is rated at 40 ohms and 2.0 watts. Resistor 68 is connected in parallel to SCR 76, diode 69 and capacitor 64. Capacitor 64 is rated at 1.0 microfarad and 450 volts polarized. Capacitor 64 is connected at point 72 to first winding 78 around pulse transformer core 80. Second winding 79 around pulse transformer core 80 is connected at point 74 to diode 70. High voltage rectifier diode 70 is rated at 10 kilovolts and an average forward current of 25 milliamp, and is connected to output point 77. The ratio of the number of turns in the first winding 78 to the number of turns in the second winding 79 is 1:125, around pulse transformer core 80.

The output of the second stage is as follows: pulsed DC for the positive plate of the capacitive coupling is provided at output point 77; and the common ground for the metal object is provided at output point 73.

Figure 5:
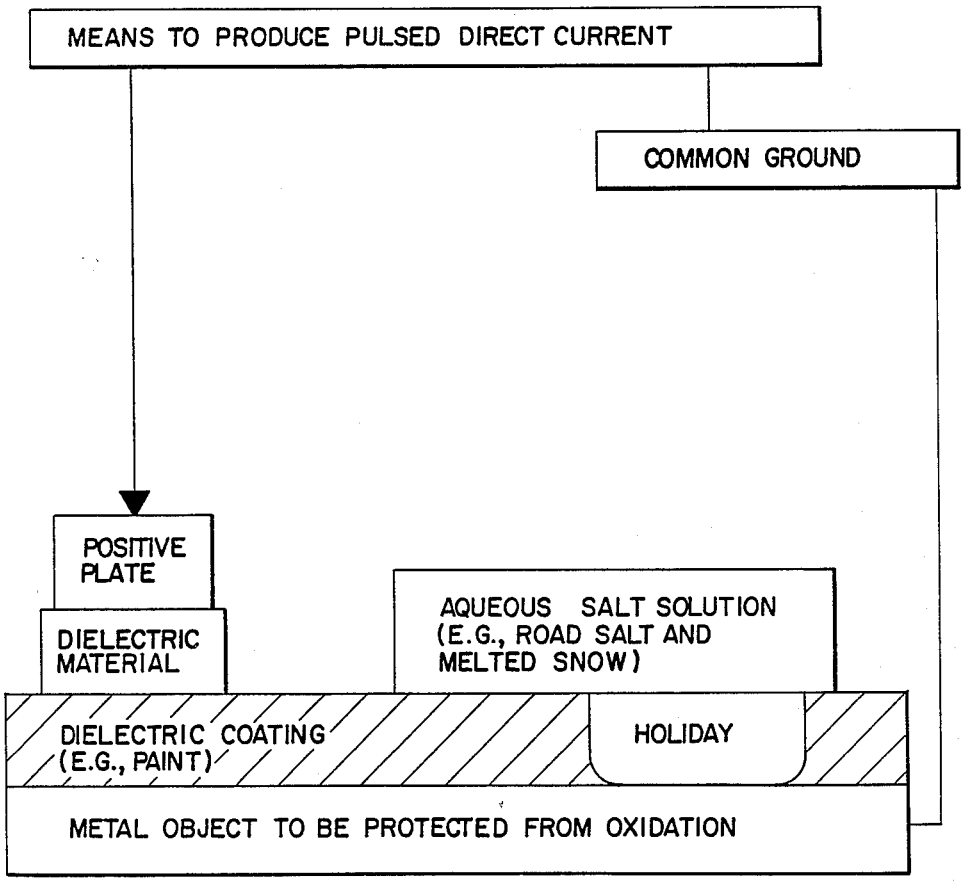
FIG. 5 is a schematic diagram of a process and apparatus of the present invention.

FIG. 5 provides a schematic diagram of a process and apparatus of the present invention. A means to produce pulsed direct current is connected to the positive plate of the capacitive coupling. The positive plate is adjacent to a dielectric material, which is adjacent to the metal object. The metal object functions as the negative plate in the capacitive coupling. The means to produce pulsed direct current then provides pulses of direct current to the positive plate. During each cycle of the capacitive coupling, a positive charge is created on the positive plate. This causes a negative charge to develop in that portion of the metal object, which is immediately adjacent to the dielectric material. As the cycle of the capacitive coupling is completed, the positive charge on the positive plate decreases. This causes a decrease in the negative charge on the portion of the metal object, which is adjacent to the dielectric material. Accordingly, as the capacitive coupling goes through repetitive cycles, the electrons in the metal object to be protected, are initially drawn toward the capacitive coupling, and then repelled away from the capacitive coupling, which creates the impressed current in the metal object.

This creates a pumping of electrons which increases the tendency of surplus electrons from the impressed current to bleed off from the metal object. If a conductive layer (such as an aqueous salt solution) is adjacent the relatively dielectric coating on the metal object then the negative charge on the metal object induces a positive charge on the conductive layer. This forms a capacitive surface. Accordingly, if a holiday (generally speaking, a "holiday" means any break in the relatively dielectric coating, which allows direct contact between the surface of the metal object and the aqueous salt solution) provides a relatively direct route for electrons on the surface of the metal object to travel to the chemical substances in the aqueous salt solution with sufficient reduction potentials to be reduced, then these electrons follow this route. This satisfies the tendency of the reducing agents in the electrolyte to take on electrons, by providing electrons from the current rather than from the metal by oxidation. Obviously, FIG. 5 is not drawn to scale, as the size of the metal object will in most cases be much much larger than the area of the capacitive coupling with the dielectric material and the positive plate.

We claim:

1. A process of reducing the rate of oxidation of a metal object comprising the steps of attaching a capacitive coupling to said metal object, wherein said capacitive coupling comprises a dielectric material attached to said metal object and a positive plate attached to said dielectric material and said metal object is not a negative plate of a conventional capacitor, attaching the positive output of a means for providing pulses of direct current to said positive plate, and attaching the negative output of said pulse providing means to said metal object, and activating said pulse providing means whereby a current sufficient to provide electrons to reducing chemicals in the environment immediately surrounding said metal object is impressed in said metal object.

2. The process of claim 1, wherein said pulses are generated by a two stage system, the first stage of said system providing a first voltage of alternating current and a second voltage of alternating current, wherein said second voltage is lower than said first voltage, and the second stage of said system rectifying both of said first and second alternating current voltages from said first stage into direct current, and then pulsating said direct current.

3. The process of claim 1, wherein said direct current pulses are from about $10^{-6}$ to about $10^{+6}$ volts, have a current in the microamp range, and have a frequency of from about 1.0 to about $10^{+6}$ hertz.

4. The process of claim 3, wherein said dielectric material has a puncture voltage of at least about 10 kilovolts.

5. The process of claim 4, wherein said direct current pulses are from about 5,000 volts to about 6,000 volts, and have a frequency of about 1.0 kilohertz.

6. The process of claim 1, wherein said direct current pulses are from about $10^{-6}$ to about $10^{+6}$ volts, have a current in the microamp range, and have a frequency of from about 1.0 to about $10^{+6}$ hertz, and wherein said metal object is not electrically grounded to the earth.

7. The process of claim 6, wherein said dielectric material has a puncture voltage of at least about 10 kilovolts.

8. The process of claim 7, wherein said direct current pulses are from about 5,000 volts to about 6,000 volts, and have a frequency of about 1.0 kilohertz.

9. The process of claim 8, wherein said metal object is an automobile or a truck.

10. Apparatus for reducing the rate of oxidation of a metal object consisting of a positive plate, a dielectric material adapted to form a dielectric barrier between said positive plate and a surface of a metal object, means for providing pulses of direct current to said positive plate, and means for providing a common ground between said pulse providing means and said metal object, and said metal object is not a negative plate of a conventional capacitor.

11. The apparatus of claim 10, further comprising means to attach said positive plate to said dielectric material, and means to attach said dielectric material to said metal object.

12. The apparatus of claim 11, wherein said pulses are generated by a two stage system, the first stage of said system providing a first voltage of alternating current and a second voltage of alternating current, wherein said second voltage is lower than said first voltage, and the second stage of said system being adapted to rectify both of said first and second alternating current voltages from said first stage into direct current, and then pulsating said direct current.

13. The apparatus of claim 10, wherein said direct current pulses are from about $10^{-6}$ to about $10^{+6}$ volts, have a current in the microamp range, and have a frequency of from about 1.0 to about $10^{+6}$ hertz.

14. The apparatus of claim 13, wherein said direct current pulses are from about 5,000 volts to about 6,000 volts, and have a frequency of about 1.0 kilohertz, wherein said dielectric material has a puncture voltage of at least about 10 kilovolts, and wherein said metal object is an automobile or a truck.

15. A structure comprising a metal object to be protected from oxidation, a dielectric material attached to said metal object, and a positive plate attached to said dielectric material, so as to form a capacitive coupling between said positive plate, said dielectric material and said metal object, and further comprising means to provide pulsed direct current to said positive plate, wherein said pulse providing means and said metal object have a common ground, and said metal object is not a negative plate of a conventional capacitor.

16. The structure of claim 15, wherein said direct current pulses are from about $10^{-6}$ to about $10^{+6}$ volts, have a current in the microamp range, and have a frequency of from about 1.0 to about $10^{+6}$ hertz, and wherein said dielectric material has a puncture voltage of at least about 10 kilovolts.

17. The structure of claim 16, wherein said direct current pulses are from about 5,000 volts to about 6,000 volts, and have a frequency of about 1.0 kilohertz.

18. The structure of claim 15, wherein said direct current pulses are from about $10^{-6}$ to about $10^{+6}$ volts, have a current in the microamp range, and have a frequency of from about 1.0 to about $10^{+6}$ hertz, wherein said dielectric material has a puncture voltage of at least about 10 kilovolts, and wherein said metal object is not grounded to the earth.

19. The structure of claim 18, wherein said direct current pulses are from about 5,000 volts to about 6,000 volts, and have a frequency of about 1.0 kilohertz.

20. The structure of claim 19, wherein said metal object is an automobile or a truck.

* * * * *